US011434896B2

(12) United States Patent
Chamot et al.

(10) Patent No.: US 11,434,896 B2
(45) Date of Patent: Sep. 6, 2022

(54) GOVERNOR DEVICE FOR CONTROLLING A COMPRESSOR

(71) Applicant: WABCO EUROPE BVBA, Brussels (BE)

(72) Inventors: Marcin Chamot, Kamienna Góra (PL); Radoslaw Czapiewski, Wroclaw (DE); Marcin Juszczynski, Siechnice (PL); Kamil Kostrzewa, Wroclaw (PL)

(73) Assignee: ZF CV SYSTEMS EUROPE BV, Brussels (BE)

( * ) Notice: Subject to any disclaimer, the term of this patent is extended or adjusted under 35 U.S.C. 154(b) by 206 days.

(21) Appl. No.: 16/759,002

(22) PCT Filed: Sep. 6, 2018

(86) PCT No.: PCT/EP2018/073972
§ 371 (c)(1),
(2) Date: Apr. 24, 2020

(87) PCT Pub. No.: WO2019/081113
PCT Pub. Date: May 2, 2019

(65) Prior Publication Data

US 2021/0180587 A1 Jun. 17, 2021

(30) Foreign Application Priority Data

Oct. 25, 2017 (EP) ..... 17198185

(51) Int. Cl.
*F04B 49/02* (2006.01)
*F04B 53/10* (2006.01)
(Continued)

(52) U.S. Cl.
CPC ..... *F04B 49/022* (2013.01); *F04B 39/16* (2013.01); *F04B 49/243* (2013.01); *F04B 53/10* (2013.01)

(58) Field of Classification Search
CPC .... F04B 49/225; F04B 49/243; F04B 49/022; F04B 53/10; F04B 53/14; F04B 53/16; B60T 13/26
See application file for complete search history.

(56) References Cited

U.S. PATENT DOCUMENTS 1,836,416 A * 12/1931 Weber ..... F04B 41/02 137/529
1,965,070 A * 7/1934 Cumming ..... B60T 17/02 137/102

(Continued)

FOREIGN PATENT DOCUMENTS

GB 1006806 A 10/1965
JP 2008253898 A * 10/2008
WO 1995011384 A1 4/1995

OTHER PUBLICATIONS

English Machine Translation of JP-2008253898-A (Year: 2008).*
International Search Report for PCT/EP2018/073972 dated Oct. 10, 2018, 4 pages.

*Primary Examiner* — Nathan C Zollinger
(74) *Attorney, Agent, or Firm* — Warner Norcross + Judd LLP

(57) ABSTRACT

Disclosed is a governor device for controlling a compressor in a pressurized air system. The governor device includes a supply port, a control port, an exhaust opening, an inlet valve between the supply port and the control port, and an outlet valve between the control port and the exhaust opening. The governor device also includes a displaceable piston and is switchable between a basic position with an open outlet valve and closed inlet valve and an actuated position with a closed outlet valve and open inlet valve. A valve arrangement is included at the piston, the valve arrangement comprising a fixed means fixed to the piston and a valve plate displaceable with respect to the fixed means.

10 Claims, 3 Drawing Sheets

(51) Int. Cl.
*F04B 39/16* (2006.01)
*F04B 49/24* (2006.01)

(56) References Cited

U.S. PATENT DOCUMENTS

| | | | | | |
|---|---|---|---|---|---|
| 2,256,565 | A | * | 9/1941 | Burr | F04B 49/06 137/565.16 |
| 2,501,706 | A | * | 3/1950 | Bent | F04B 49/00 137/494 |
| 2,817,356 | A | * | 12/1957 | Glass | G05D 16/101 137/469 |
| 3,002,520 | A | * | 10/1961 | Morse | F16K 31/363 137/102 |
| 3,481,359 | A | * | 12/1969 | Werner | G05D 16/028 417/302 |
| 3,545,887 | A | | 12/1970 | Kobnick | |
| 3,670,756 | A | * | 6/1972 | Schultz | B60T 15/50 137/102 |
| 3,834,837 | A | * | 9/1974 | Nickell | F04B 39/125 417/298 |
| 5,694,965 | A | * | 12/1997 | Roulet | G05D 16/109 137/102 |
| 6,038,856 | A | | 3/2000 | Knaust | |
| 2004/0040601 | A1 | | 3/2004 | Koelzer | |
| 2014/0116534 | A1 | | 5/2014 | Howell et al. | |

* cited by examiner

GOVERNOR DEVICE FOR CONTROLLING A COMPRESSOR

CROSS-REFERENCE TO RELATED APPLICATIONS

This application is the National Stage of International Application No. PCT/EP2018/073972, filed on 6 Sep. 2018, which claims priority to and all advantages of European Patent Application No. 17198185.5, filed on 25 Oct. 2017, the contents of which are hereby incorporated by reference.

FIELD OF THE INVENTION

The invention refers to a governor device for monitoring a supply pressure and controlling a compressor, in particular in an pressurized air system of a vehicle, and such a pressurized air system to be used in a vehicle.

BACKGROUND OF THE INVENTION

Pressurized air systems in vehicles in general comprise a compressor to be driven by the motor or engine of the vehicle. The compressor supplies pressurized air to a supply tank or supply tank system, which in turn supplies consumer circuits, e. g. air brake circuits or suspension circuits of said compressed air system. Thus the compressor is to be controlled in dependence of the supply pressure stored in the supply tank.

A pressure monitoring device known as "governor" is provided for monitoring the supply pressure; the governor comprises a supply port to be connected to the supply tank, an exhaust port and a control output port for outputting a pressure signal to an unloader valve of the compressor. If the pressure of the supply tank exceeds a first pressure threshold, the cut-out-pressure, then the governor outputs a pressure signal to switch the compressor into its off-load-state, which may be a switched-off state or an idle state, in which the compressor is not switched off. In general, governors comprise a spring mechanism to compare the supply pressure with a spring force of the spring mechanism; thus a movable piston of the governor is charged with the supply pressure on its bottom (active) face and biased by the spring mechanism on its top face (back face).

In the basic position of the governor its control output port is connected to its exhaust port thereby exhausting the control conduit between the control output port and the compressor. If the supply pressure exceeds the cut-out-pressure, the governor switches and connects its supply port to its control output port thereby pressurizing (venting) the control conduit, which realizes the pressure signal to the compressor.

GB 1,006,806 A, U.S. Pat. Nos. 3,834,837, 3,545,887 disclose governors realized as mechanical devices comprising mechanical parts.

US 2014/0116534 A1 describes a heat-exchange dryer apparatus comprising a compressed-air conduit and a purge-air reservoir, which purge-air reservoir comprises a material having a heat transfer coefficient that is at least about 100 W/mK.

BRIEF SUMMARY OF THE INVENTION

Thus the governor device comprises a piston to be charged at its bottom surface (active surface) by said supply pressure, said piston being biased by a spring. Thus a cut_out pressure for switching between a basic state and an actuated state can be realized by a spring, in particular a helical spring, by balancing the spring force and the supply pressure force acting on the piston.

The inlet valve and outlet valve are realized by a valve arrangement provided at or fixed to said piston, said valve arrangement comprising a fixed means fixed to said piston and a valve plate displaceable with respect to said fixed means.

Thus a compact design with small size is realized, in which the inlet valve and outlet valve can be integrated into the main parts, in particular the piston. The weight can be reduced with respect to systems using more external elements.

According to a specific embodiment the piston is slidably provided inside an insert screwed into a dome; the dome is any part to be fixed at an external part, in particular an external casing, as e.g. an air dryer casing. Thus main functional parts of the governor can be realised in the insert. The insert can be pre-assembled and adjusted and afterwards the insert can be screwed into the dome, which in turn can be screwed into the external casing.

Pre-assembling is therefore ease to handle, since most parts can be adjusted and pre-assembled in the insert. Mounting of the governor can be done in one screwing operation with an axial automotive socket tool. In particular mounting is possible without additional fasteners. The governor comprising the complete valve arrangement can already be pre-set and pre-tested before mounting it.

The valve arrangement typically comprises an exhaust passage formed in the fixed means, which exhaust passage is sealable by the valve plate, which can be realized as a valve disc. These parts thereby form the outlet valve.

Thus the piston can be charged with the supply pressure to be compared with the spring force; the axial position of the piston within the insert thus depends on the supply pressure. The valve arrangement can thereby be switched either into its basic position with open outlet valve and closed inlet valve or into its an actuated position with closed outlet valve and open inlet valve, only in dependence of the position of the piston.

Furthermore external part comprising a material with low heat transfer factor can be used for insulating internal (elastomer parts) parts of the governor from heat stress.

BRIEF DESCRIPTION OF THE DRAWINGS

The invention is explained in more detail below by means of exemplary embodiments shown in the drawings, wherein.

DETAILED DESCRIPTION

Figure 1:
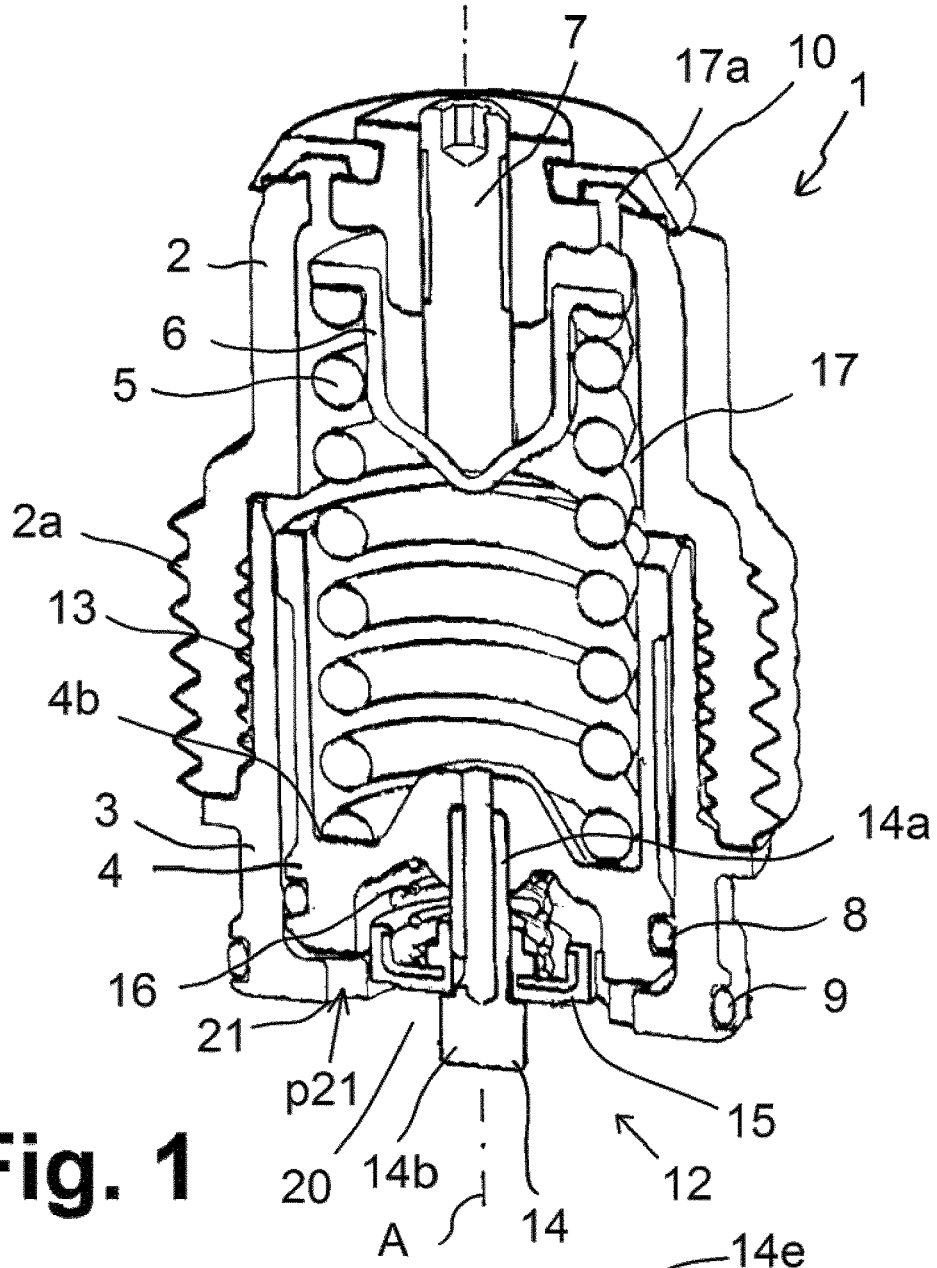
FIG. 1 is a sectional perspective view of a governor according to one embodiment of the invention.
Figure 2:
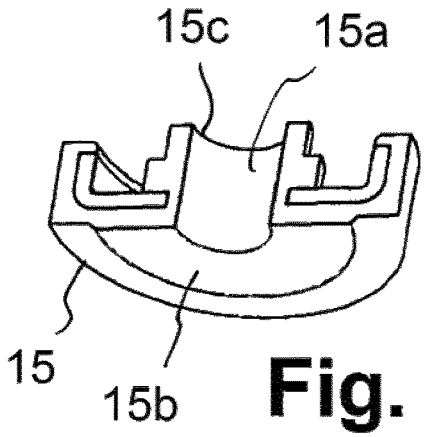
FIG. 2 is a sectional perspective view of the valve plate.
Figure 3:
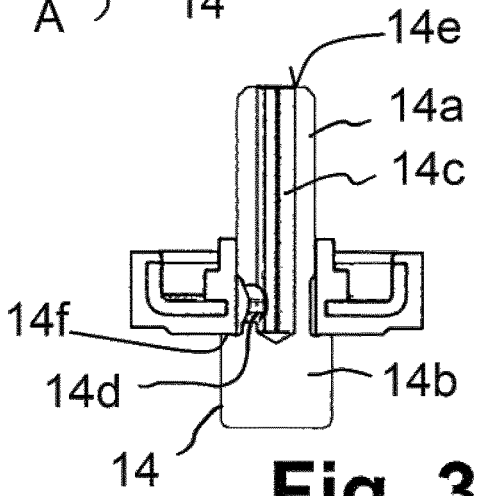
FIG. 3 is a sectional view of the valve arrangement.

A governor 1 is provided in a pressurised air system of a vehicle in order to switch a compressor on and off in dependence of a supply pressure p21 provided in a supply tank 22. Thus the governor 1 detects a system pressure p21 of the supply tank 22 and outputs a control pressure p1 as a pressure signal to the control input of the compressor 24; this control input can be realised for example as part of an unloader valve of the compressor 24.

The governor 1 comprises a dome 2 serving as a cover and being fixed, in particular screwed with its outer thread 2*a* into a casing 30, further an insert 3 screwed into the dome 1, a piston 4 slidably provided inside the insert 3, a spring 5 and a spring cap 6, wherein the spring 5 is provided between the spring cap 6 and the piston 4 and acts upon the top surface 4*b* of the piston 4.

Thus main parts of the governor 1 are realised in the insert 3, which is fixed in the dome by an insert thread connection 13. Pre-assembling is therefore ease to handle, since most parts can be adjusted and pre-assembled in the insert 3.

Further the governor 1 comprises a regulation screw 7 for adjusting a bias force of the spring 5 by pushing the spring cap 6. The piston 4 is sealed inside the insert 3 by a dynamic O-ring 8; further a static O-ring 9 and a protection cover 10 are provided; the regulation screw 7 is screwed into a screw thread part 11 fixed to the protection cover 10.

A valve arrangement 12 is provided inside the piston 4 and extends under the piston 4; said valve arrangement 12 is explained more in detail with respect to FIGS. 2 to 5. The valve arrangement 12 comprises a stem 14 provided in the piston 4, for example by a thread (or interference fitting), further a valve plate 15 (valve disc) and a valve spring 16 provided between the piston 4 and the valve plate 15.

The valve plate 15 surrounds a smaller top part 14*a* of the stem 14 and is biased by the valve spring 16. The stem 14 comprises a blind hole 14*c* starting from the top face 14*e*, extending through the smaller top part 14*a* and ending in the thicker bottom part 14*b*. A drilling 14*d* extends vertically to the axis A from the outside through the wall of the smaller top part 14*a* to the blind hole 14*c*.

The valve plate 15 comprises a central hole 15*a* surrounding the smaller top part 14*a* of the stem; thus the valve plate 15 is displaceable (shiftable) in the top part 14*a* of the stem 14 along the axis A. The valve plate 15 further comprises at its bottom face a ring-shaped sealing surface 15*b* surrounding the central hole 15*a*. Furthermore the valve plate 15 comprises a lip seal 15*c* at the top of the central hole 15*a*.

These features enable the valve arrangement 12 to realize the following valve functions:

a) Inlet Valve Between Control Port 20 and Supply Port 21

Figure 4:
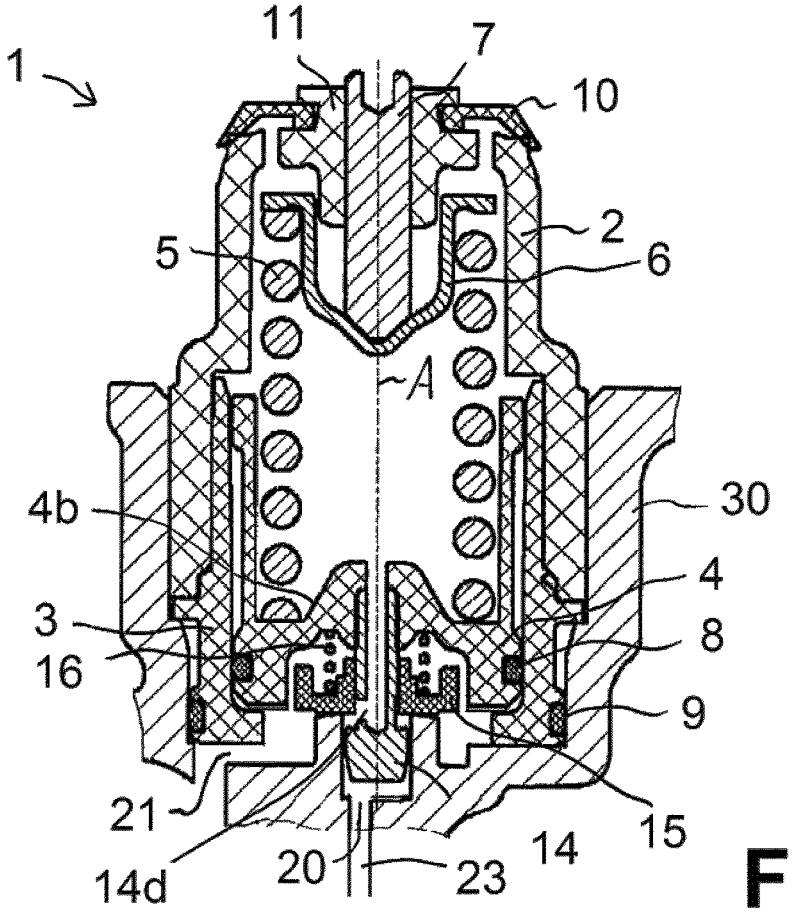
FIG. 4 is a sectional view of the governor in its basic state (consumption, cut-in)

The sealing surface 15*b* of the valve plate 15 and a casing sealing surface 25 of the casing 30 serving as an inlet valve (The casing 30 is e.g. part of an air dryer body):

Closed Inlet Valve, FIG. 4:

is in the basic position of FIG. 4 the piston 4 is in its lowest position. Thus the valve plate 15 is pressed with its sealing surface 15*b* against the casing sealing surface 25 thereby closing a passage between a supply port 21, which is connected to the supply tank 22, and a control port 20 to be connected to the control input of the compressor. Therefore the inlet valve is closed.

Figure 5:
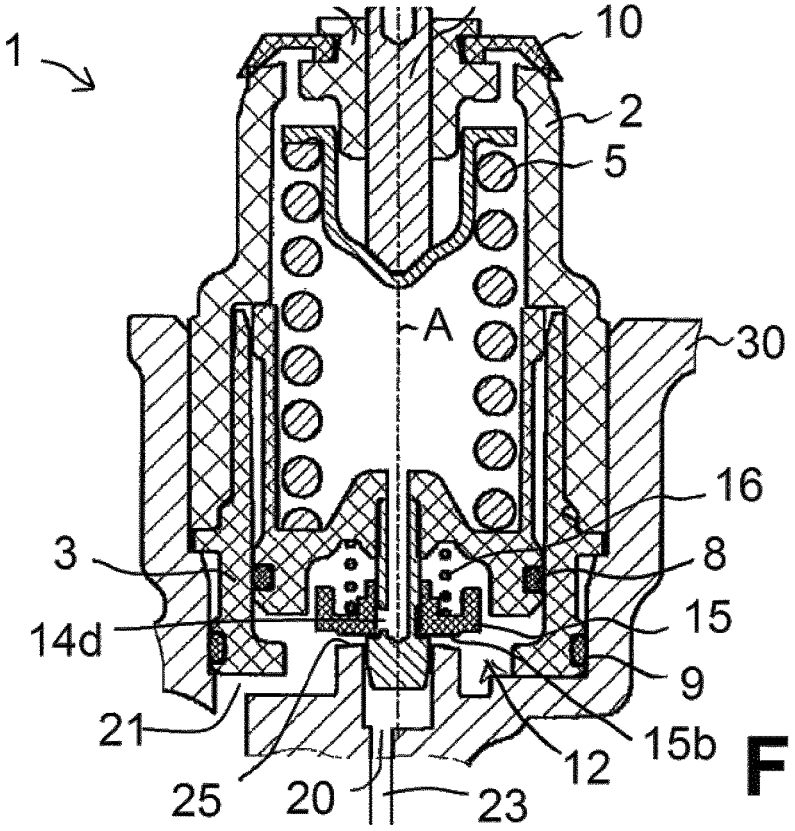
FIG. 5 the valve arrangement of FIG. 3 in its actuated state (cut-out, off load phase)
Figure 6:
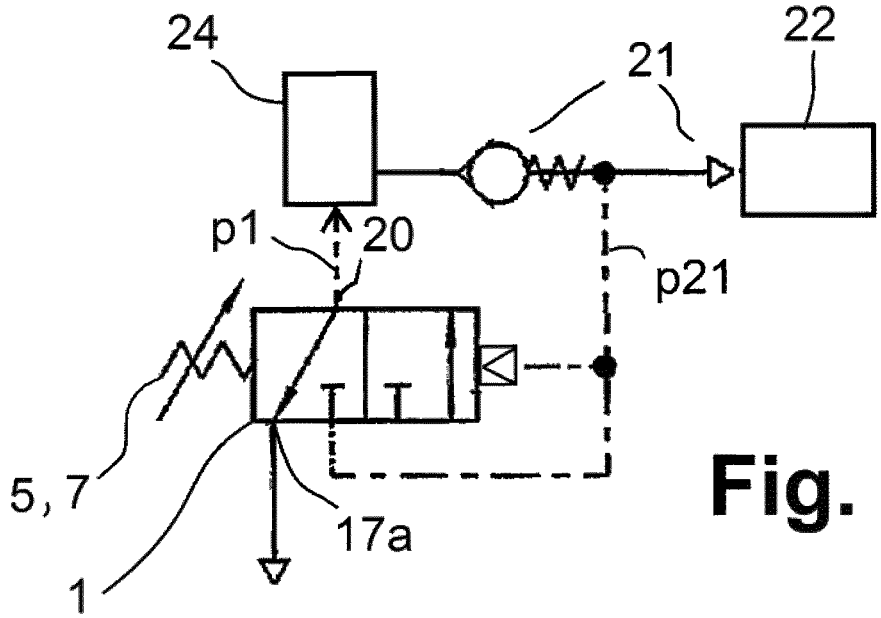
FIG. 6 depicts a pneumatic symbolic scheme representing the governor.

Open Inlet Valve, FIG. 5:

The control port 20 is provided in the casing 30 under the bottom part 14*b* of the stem 14; air can pass the bottom part 14*b* in axial direction along passages surrounding the bottom part 14*b*. Thus if the valve plate 15 detaches according to the actuated position of FIG. 5 and gets out of contact with the casing sealing surface 25, air from the supply port 21 can enter the control port 20; therefore the inlet valve is open. The control port 20 is therefore pneumatically connected to a control channel 23 provided in the casing 30.

b) Outlet Valve Between Control Port 20 and Exhaust Chamber 17

The second valve function realises an outlet valve between the control port 20 and the exhaust chamber 17 provided above the piston 4: the control port 20 is connected to the passages surrounding the bottom part 14*b* of the stem 14; these passages extend to the drilling 14*d* of the stem 14.

Closed Outlet Valve, FIG. 5:

If the drilling 14*d* is closed by the lip seal 15*c* and the sealing surface 15*b* of the valve plate 15 is pressed to the sealing seat 14*f* of the stem 14, then the control port 20 is disconnected from the exhaust chamber 17; the outlet valve is closed.

Open Outlet Valve, FIG. 4:

If the drilling 14*d* is not sealed, the control port 20 can exhaust through the passages around the bottom part 14*b*, the drilling 14*d* and the blind hole 14*c* of the stem 14, upward to the exhaust chamber 17, which is connected to the outer space via exhaust holes 17*a*. Thus the drilling 14*d* and the blind hole 14*c* realize an exhaust passage formed in the stem 14.

FIG. 4 depicts the idle condition or basic position of the valve arrangement 12: the pressure p21 of the supply chamber 22, acting through the supply port 21 onto the bottom face 4*a* of the piston 4 is not high enough to overcome the bias spring force of the spring 5. Thus the inlet valve consisting of the sealing surface 15*b* and the casing sealing surface 25 is closed, since the piston 4 is pressed into its lowest position, in which the valve plate 15 is pressed onto the casing sealing surface 25. The spring force of the valve spring 16 is considerably lower than the bias spring force of the spring 5 and therefore not relevant in this content.

In this idle condition or basic position the control port 20 is connected via the passages surrounding the bottom part 14*b* of the stem 14 to the area surrounding the smaller top part 14*a* of the stem 14 and via the drilling 14*d* to the blind hole 14*c* and to the exhaust chamber 17. Therefore the control port 20 is exhausted, and the compressor receives the pressure signal p1=0 (1 bar) for continuing pressurising air.

Figure 7:
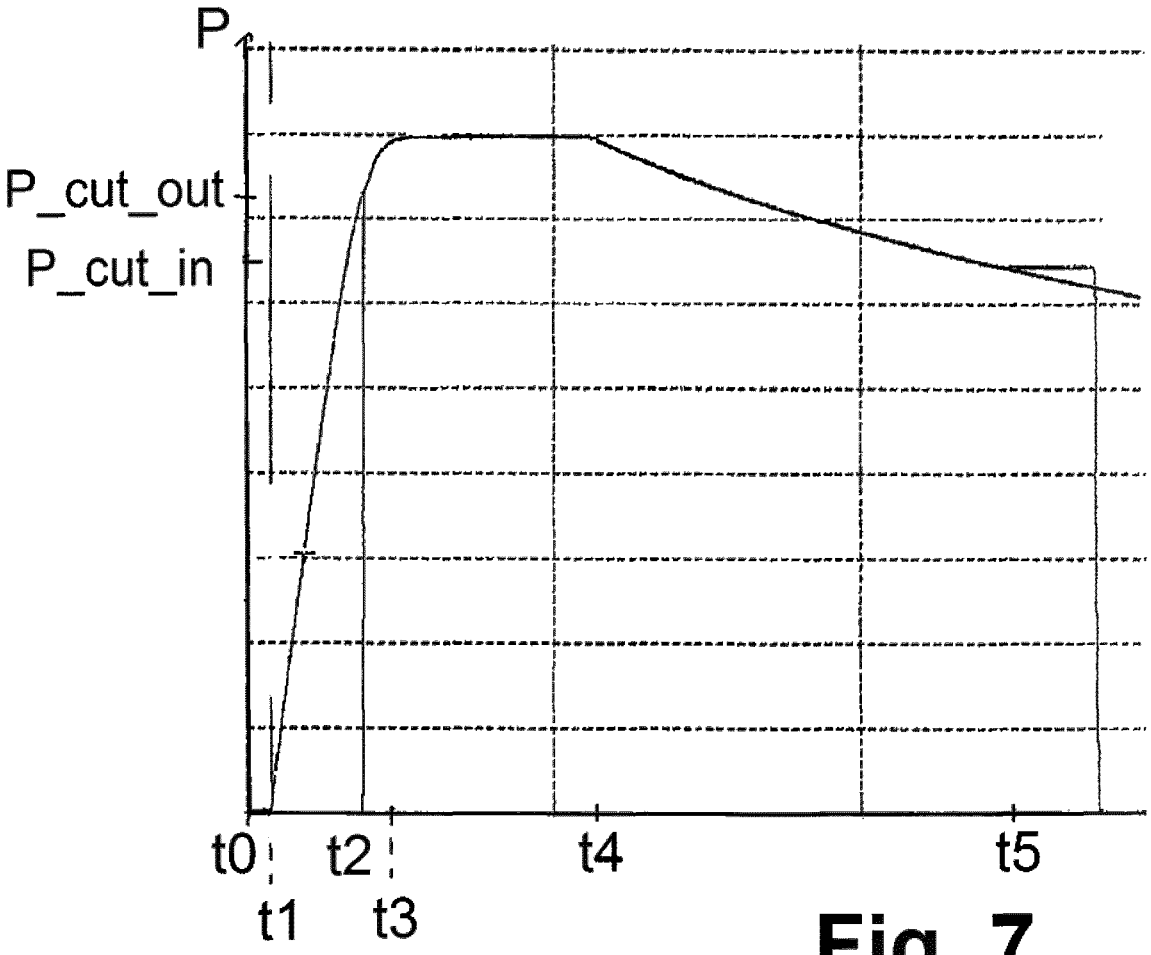
FIG. 7 is a diagram of the pressure as a function of time during subsequent phases.

If the supply pressure p21 in the supply port 21 rises, see the diagram of FIG. 7, and reaches a cut-out level, then the force exerted by the pressure onto the bottom face 4*a* of the piston 4 is higher than the bias spring force of the spring 5 Therefore the piston 4 is moved upward, thereby disengaging the sealing surface 15*b* of the valve plate 15 from casing sealing surface 25 and thereby opening the inlet valve. Further the outlet valve realized by the lip seal 15*c*, the drilling 14*d*, sealing surface 15*b* and sealing seat 14*f* of stem is closed by the relative axial movement of the valve plate 15 with respect to the stem 14; this movement is enabled by the valve spring 16, which presses the valve plate 15 downward.

Thus the two valve functions are realized by the relative position of the valve plate 15, with respect to the fixed insert 3 (insert valve), and the relative position of the valve plate 15 with respect to the stem 14, which is fixed to the piston 4.

FIG. 7 displays a pressure-time-diagram of the supply pressure p21. Starting at time t0, the compressor starts to compress; at time t1 the pressure p1 starts to rise until time t2, in which the cut-out pressure P_cut_out is reached, thereby opening the inlet valve and closing the outlet valve, as described above. At t3 the pressure p21 levels out to a maximum plateau, and then at t4 starts to fall due to consumption by the connected air circuits, for example air brake circuits. At t5 the pressure p21 reaches the cut-in pressure P_cut_in, thereby closing the inlet valve and opening the outlet valve, as already described above.

LIST OF REFERENCE NUMERALS (PART OF THE DESCRIPTION)

1 governor
2 dome
2*a* outer thread of the dome 2
3 insert
4 piston
4*a* bottom face of the piston 4
4*b* top surface of the piston 4
5 spring
6 spring cap
7 regulation screw
8 dynamic o-ring
9 static o-ring
10 protection cover
11 screw thread part fixed to protection cover 10
12 valve arrangement
13 insert thread connection between dome 2 and insert 3
14 stem
14*a* smaller top part
14*b* thicker bottom part
14*c* blind hole
14*d* drilling vertical to the blind hole and the axis A
14*e* top face of the stem
14*f* sealing seat of the stem
15 valve plate, valve disc
15*a* central hole
15*b* sealing surface
15*c* lip seal
16 valve spring for biasing said valve plate 15
17 exhaust chamber
17*a* exhaust hole
20 control port
21 supply port, supply port to the supply chamber
22 supply tank
23 control channel in the casing 30
24 compressor
25 casing sealing surface
30 casing 30
A axis
p21 supply pressure
p1 control pressure
P_cut_in cut-in pressure
P_cut_out cut-out pressure

The invention claimed is:

1. A governor device for controlling a compressor in a pressurized air system, said governor device comprising:
- a supply port for receiving a supply pressure,
- a control port for delivering a control pressure to said compressor,
- an exhaust opening for exhausting air,
- an inlet valve provided between said supply port and said control port, and
- an outlet valve provided between said control port and said exhaust opening,
- a displaceable piston, an active bottom face of said piston being chargeable with the supply pressure to exert a pressure force,
- a spring means for biasing said piston with a bias force against said pressure force of the supply pressure,
- wherein said governor device is switchable between a basic position with an open outlet valve and a closed inlet valve and an actuated position with a closed outlet valve and an open inlet valve,
- wherein a valve arrangement is provided at said piston, said valve arrangement comprising a fixed means fixed to said piston and a valve plate displaceable with respect to said fixed means, wherein said fixed means comprises an exhaust passage to be sealed by a lip seal of said valve plate in said actuated position thereby realizing said outlet valve,
- wherein said inlet valve and said outlet valve are realized by said valve arrangement;
- wherein said lip seal is provided on a central hole of said valve plate, said central hole surrounding said fixed means for realizing said outlet valve, and
- wherein said valve plate is moveable in an axial direction with respect to said fixed means, for closing and opening a drilling passage in dependence of the piston position.

2. The governor device according to claim 1, wherein in said basic position the supply pressure does not exceed the bias force, and in said actuated position the supply pressure exceeds the bias force.

3. The governor device according to claim 1, further comprising a dome to be fixed in an external part, and an insert screwed into said dome, wherein said piston is slidably provided inside said insert.

4. The governor device according to claim 1, wherein said fixed means is screwed into said piston and defines a hole, and wherein said exhaust passage is realized by said hole extending in the axial direction and a drilling passage extending perpendicular to the axial direction.

5. The governor device according to claim 1, wherein said spring means is adjustable to adjust the bias force and defines a cut-out pressure, which exceeds the bias force.

6. A governor device for controlling a compressor in a pressurized air system, said governor device comprising:
- a supply port for receiving a supply pressure,
- a control port for delivering a control pressure to said compressor,
- an exhaust opening for exhausting air,
- an inlet valve provided between said supply port and said control port, and
- an outlet valve provided between said control port and said exhaust opening,
- a displaceable piston, an active bottom face of said piston being chargeable with the supply pressure to exert a pressure force,
- a spring means for biasing said piston with a bias force against said pressure force of the supply pressure,
- wherein said governor device is switchable between a basic position with an open outlet valve and a closed inlet valve and an actuated position with a closed outlet valve and an open inlet valve,
- wherein a valve arrangement is provided at said piston, said valve arrangement comprising a fixed means fixed to said piston and a valve plate displaceable with respect to said fixed means,
- wherein said inlet valve and said outlet valve are realized by said valve arrangement,
- wherein said inlet valve is realized by a sealing interface of said valve plate and a casing sealing surface,
- wherein a valve spring biases said valve plate with respect to said piston, and
- wherein in an idle position of said piston said valve spring presses a sealing surface of said valve plate against said casing sealing surface thereby closing said inlet valve.

7. The governor device according to claim 6, wherein in said idle position a distance between said piston and said casing sealing surface is smaller than in said actuated position.

8. The governor device according to claim 6, wherein the valve spring is provided between said bottom face of said piston to be charged by the supply pressure and said valve plate.

9. A pressurized air system, comprising the governor device according to claim 6, and a casing receiving and housing said governor device, wherein said casing sealing surface is provided at said casing, and wherein a control channel is formed in said casing extending to said control port.

10. The pressurized air system according to claim 9, wherein said casing is an air dryer casing of an air dryer.

* * * * *